US007488884B2

(12) United States Patent
Ohno et al.

(10) Patent No.: US 7,488,884 B2
(45) Date of Patent: Feb. 10, 2009

(54) KEYBOARD MUSICAL INSTRUMENT HAVING SLOPED TOP SURFACE

(75) Inventors: Masaharu Ohno, Hamamatsu (JP); Tomonori Ichikawa, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 224 days.

(21) Appl. No.: 10/831,609

(22) Filed: Apr. 23, 2004

(65) Prior Publication Data

US 2004/0250671 A1 Dec. 16, 2004

(30) Foreign Application Priority Data

Apr. 28, 2003 (JP) ..... 2003-123409

(51) Int. Cl.
*G10D 3/00* (2006.01)

(52) U.S. Cl. ..... 84/423 R

(58) Field of Classification Search ..... 84/425, 84/447, 423 R, 438, 432
See application file for complete search history.

(56) References Cited

U.S. PATENT DOCUMENTS 4,656,913 A * 4/1987 Yoshikawa ..... 84/177
D400,910 S 11/1998 Mikage
6,087,574 A * 7/2000 Kitashima et al. ..... 84/423 R
6,288,313 B1 * 9/2001 Sato et al. ..... 84/177
2004/0173086 A1 * 9/2004 Sato et al. ..... 84/745

FOREIGN PATENT DOCUMENTS

| | | |
|---|---|---|
| JP | 48-004487 | 2/1973 |
| JP | 63-162398 U | 10/1988 |
| JP | 02-067393 | 5/1990 |
| JP | 03-119891 | 12/1991 |
| JP | 05-241567 | 9/1993 |
| JP | 09-230851 | 9/1997 |
| JP | 11-305761 | 11/1999 |

* cited by examiner

*Primary Examiner*—Kimberly R Lockett
(74) *Attorney, Agent, or Firm*—Morrison & Foerster LLP

(57) ABSTRACT

An electronic keyboard musical instrument has a cabinet, in which a tone generating system is housed, and the cabinet offers a sloped top surface to assistant goods; while the player is composing a piece of music with the assistance of a personal computer system, by way of example, the player puts the computer keyboard on the sloped top surface, and manipulates the computer keyboard without taking unnatural attitude so that the player can continue the work for a long time.

20 Claims, 4 Drawing Sheets

KEYBOARD MUSICAL INSTRUMENT HAVING SLOPED TOP SURFACE

FIELD OF THE INVENTION

This invention relates to a keyboard musical instrument and, more particularly, to a cabinet of a keyboard musical instrument.

DESCRIPTION OF THE RELATED ART

In the following description, terms "front", "rear", "fore-and-aft" and "lateral" are defined with respect to a player who is performing a piece of music on a keyboard musical instrument. The term "front" modifies a position closer to the player than a corresponding position modified with the term "rear". The direction passing through a front position and the corresponding rear position is modified with the term "fore-and-aft". The term "lateral" modifies the direction crossing the fore-and-aft direction at right angle. Moreover, keyboard musical instruments are assumed to stand on a horizontal floor or a horizontal board of a desk.

Acoustic pianos, electric pianos and electronic keyboards are categorized in the keyboard musical instrument. Although the keyboards are exposed to players, most of the component parts are housed in cabinets, and participate in generation of tones. The keyboards are mechanically linked with or electrically connected to tone generating systems. The action units, hammers, dampers and vibratory strings serve as the tone generating system in the acoustic piano, i.e., the grand piano and upright piano. On the other hand, the tone generator, waveform memory and associated data processor as a whole constitute the tone generating system in the electronic keyboard.

The cabinets are to be large enough to house those component parts. A large number of mechanical component parts are assembled into the tone generating system in the acoustic piano so that the acoustic piano is bulky. A typical example of the grand piano is disclosed in Japanese Patent Application laid-open No. hei 11-305761. The prior art grand piano disclosed in the Japanese Patent Application laid-open is bulky and heavy. However, the cabinet is not high. This is because of the fact that the sound board is horizontally maintained in the piano cabinet. While pianists are fingering a music passage on the keyboard, most of the pianists notice the piano cabinet lower than their eyes. The front and rear top boards define the upper extent of the piano cabinet. The front top board is hinged at the rear end thereof to the rear top board, which in turn is hinged at the side end to the piano cabinet. When a pianist prepares the prior art grand piano for his or her performance, he or she folds back the front top board onto the rear top board, and keeps the rear top board open with the lid prop. Thus, the pianist permits the tones to be radiated from the vibrating strings to the outside of the piano cabinet during the performance. However, the pianist returns the front and rear top boards onto the side board after the performance. After returning the front and rear top boards onto the side board, the pianist notices the front top board flat and horizontal on the side board.

The standard upright piano is higher than the pianists who are sitting on a stool in front of the keyboard. The front and rear top boards also define the upper extent of the upright piano, and the front top board is foldable onto the rear top board. When the pianist returns the front top board onto the upper edge of the upper front board, he or she notices the front top board also flat and horizontal.

On the other hand, the electric/electronic component parts are so small that the electronic keyboard is usually compact. A typical example of the electronic keyboard is disclosed in Japanese Patent Application laid-open No. hei 5-241567. The side boards keep the cabinet horizontal over the floor, and the keyboard is provided between side arms. The top panel defines the upper extent of the cabinet, and is lower than the eyes of the player who is sitting on a stool in front of the keyboard. The desk board projects from the rear end portion of the top panel, and is rearward inclined. Although most of the upper surface of the top panel is horizontal, the front area is frontward sloped, and blocks the rear portions of the keys from eyes. The front area is much narrower than a sheet of paper.

The horizontal surface of the front top board and the horizontal surface of the top panel are convenient for keeping textbooks and pencils stable. However, works conducted on the front top board or top panel are not taken into account. For example, a musician is assumed to be composing a piece of music on the prior art electronic piano. He or she puts a music sheet on the top panel, and writes notes and rests on the music sheet after ascertaining the music passage on the keyboard. Another musician may put a sub-keyboard or a portable computer keyboard on the top board/panel, and composes or performs a piece of music with the assistance of the sub-keyboard or the personal computer system. If the top panel were level with the elbows of the musician sitting on a stool in front of the keyboard, the musician would conduct the composition or performance without any problem. However, the top board/panel is higher than the elbows. The musician raises the arms over the top board/panel, and turns down the hands onto the music sheet for writing the notes and rests on the music sheet. This attitude is unnatural, and makes the musician tired within a short time. Moreover, the musician feels the music sheet, sub-keyboard and/or the computer keyboard on the horizontal surface hard to see. Thus, a problem inherent in the prior art keyboard musical instruments is the shapes of the cabinets less suitable for the works possibly conducted thereon.

SUMMARY OF THE INVENTION

It is therefore an important object of the present invention to provide a keyboard musical instrument, which offers a working area to a player who gets ready to perform.

To accomplish the object, the present invention proposes to form a certain area sloping down to a player on a top surface defining an upper extent of a cabinet.

In accordance with one aspect of the present invention, there is provided a keyboard musical instrument having a fore-and-aft direction and a lateral direction comprising a cabinet including a top surface defining an upper extend of the cabinet and having a certain area sloping down toward a player who has gotten ready for a performance and keeping assistant materials stable thereon, a keyboard supported by the cabinet and manipulated by the player for the performance, and a tone generating system housed in the cabinet, and connected to the keyboard for producing tones.

BRIEF DESCRIPTION OF THE DRAWINGS

The features and advantages of the keyboard musical instrument will be more clearly understood from the following description taken in conjunction with the accompanying drawings, in which.

DESCRIPTION OF THE PREFERRED EMBODIMENTS

First Embodiment

Figure 1:
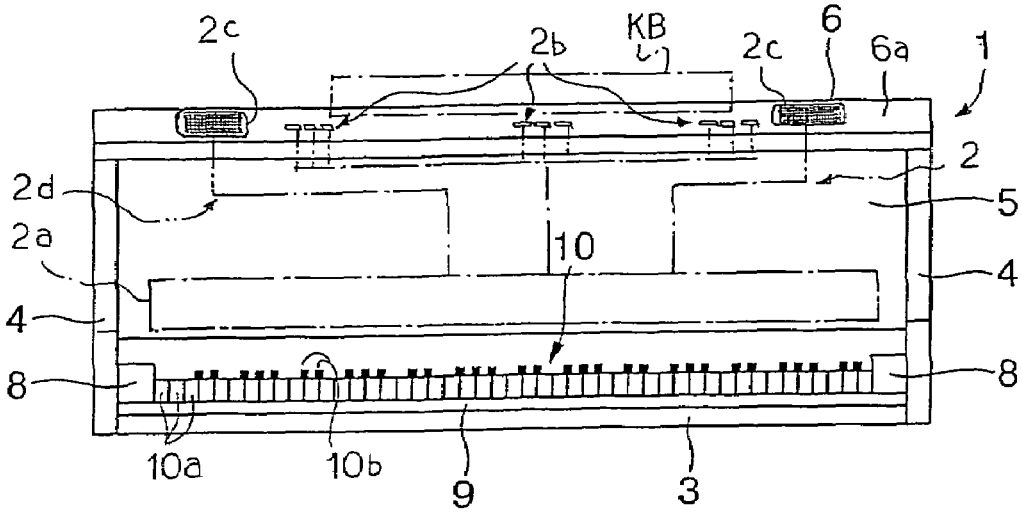
FIG. 1 is a front view showing the structure of an electronic keyboard musical instrument according to the present invention.
Figure 2:
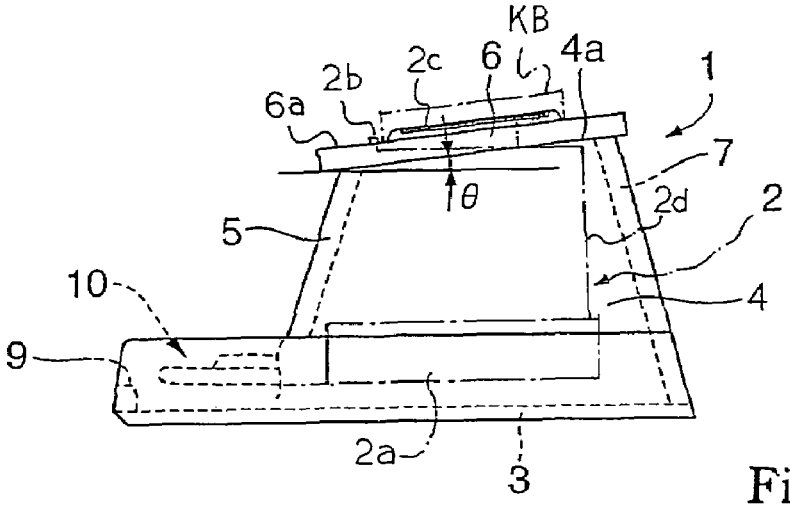
FIG. 2 is a side view showing the electronic keyboard musical instrument.

Referring to FIGS. 1 and 2 of the drawings, an electronic keyboard musical instrument embodying the present invention largely comprises a cabinet 1, a tone generating system 2 and a keyboard 10. The keyboard 10 frontward protrudes from the cabinet 1, and is manipulative by a player for designating pitches of tones to be produced. The tone generating system 2 is housed in the cabinet 1, and is connected to the keyboard 10. The tone generating system 2 is responsive to the fingering on the keyboard 10 so as electronically to produce tones. In detail, the tone generating system 2 monitors the keyboard 10 to see at what pitches the player wishes to produce tones. When the player designates the pitches through the keyboard 10, the tone generating system 2 produces an audio signal representative of the tones at the designated pitches, and converts the audio signal to the tones.

The cabinet 1 has a top surface 6*a*, and the top surface 6*a* is lower than the eyes of players who is fingering on the keyboard 10. The top surface 6*a* is frontward sloped. The sloped top surface 6*a* is so wide that the player can put a sub-keyboard/a computer keyboard/a notebook-sized personal computer and a music sheet thereon. The sub-keyboard KB is, by way of example, indicated by dot-and-dash lines in FIGS. 1 and 2. The sloped top surface is optimized in such a manner that the player, who is fingering on the keyboard 10, can manipulate the keyboard or write notes on a staff of a music sheet without sharply bending the wrists.

A musician is assumed to compose a piece of music with assistance of the electronic keyboard musical instrument. He or she lays a music sheet on the sloped top surface 6*a*. Otherwise, he or she may put a computer keyboard, which is connected to a microprocessor running on a program for composing, on the sloped top surface 6*a*. The musician imagines a music passage, and produces the tones of the music passage by fingering it on the keyboard 10. When the musician feels it good, he or she writes the notes and rests on the music sheet on the top surface 6*a*. Since the top surface 6*a* is frontward sloped, the musician easily sees the staff without half rising from his or her seat, and appreciates the electronic keyboard musical instrument according to the present invention.

The cabinet 1, tone generating system 2 and keyboard 10 are hereinafter described in more detail. The cabinet 1 includes a bottom board 3, a pair of side boards 4, a front board 5, a top board 6, a rear board 7, a pair of key blocks 8 and a key slip 9. The side boards 4 define the side extent of the cabinet 1. The top board 6 is per se as wide as the cabinet 1, and defines the upper extend of the cabinet 1. The front board 5 is set back from the front end surface of the bottom board 3 so that the bottom board 3 frontward protrudes like a terrace. The rear board 7 defines the rear extent of the cabinet 1. The cabinet 1 may be mounted on a suitable pedestal, or the side boards 4 may downwardly extend below the bottom board 3 so as to keep the keyboard 10 around the elbows of players who is sitting on a stool.

The bottom board 3 has a generally rectangular top surface, and is wider then the keyboard 10. The side boards 4 are upright from both sides of the bottom board 3, respectively, and are spaced from each other by a distance approximately equal to the total width of the bottom board 3 and key blocks 8. The rear board 7 laterally extends between the rear end surfaces of the side boards 4, and are secured to the side boards 4.

The top surfaces 4*a* of the side boards 4 are frontward sloped, and the top board 5 is constant in thickness. The top board 6 is put on the top surfaces 4*a*, and is secured to the side boards 4, rear board 7 and front board 5 by means of screws. For this reason, the top board 6 is inclined, and the top surface 6*a* is sloped at è. In this instance, the angle è ranges from 5 degrees to 30 degrees. The optimum angle è is dependent on the difference in height between the eyes and the top surface 6*a* and the distance between the eyes and the top surface 6*a*.

The top board 6 is formed with a pair of rectangular holes and small holes. As will be described hereinlater, loud speakers 2*c* and switches 2*b* are respectively exposed to the outside of the cabinet 1 through the rectangular holes and small holes, respectively.

Although the lower portions of the side boards 4 are equal in length to the bottom board 3, the upper portions are set back from the lower portions, and are gradually reduced toward the top surfaces 4*a* like a trapezoid. The front board 5 extends between the upper portions of the side boards 4, and is secured to the side boards 4. For this reason, the bottom board 3 is left between the lower portions of the side boards 4 like a terrace, and a slot is opened between the bottom board 3 and the front board 5. The keyboard 10 frontward projects through the slot, and the key blocks 8 are provided between the side boards 4 and the keyboard 10. Thus, the keyboard 10 is partially hidden inside the cabinet 1, and is partially exposed to the outside of the cabinet 1. The key slip 9 laterally extends along the front end of the bottom board 3, and is secured to the bottom board 3. The key slip 9 permits white keys 10*a* and black keys 10*b* to be swung by a player, and blocks the slot from eyes.

The keyboard 10 includes the white keys 10*a* and black keys 10*b*, and the white and black keys 10*a*/10*b* are laid on the well-known pattern. The tone generating system 2 includes electric/electronic circuits 2*a*, the switches 2*b*, loud speakers 2*c* and conductive leads 2*d*. A key switch array, a tone generator, a waveform memory, a program memory, a working memory, a microprocessor, an interface, a digital-to-analog converter and an amplifier are several examples of the electric/electronic circuits 2*a*. The switches 2*b* are connected through the interface and conductive leads 2*d* to the microprocessor, and a user give instructions to the microprocessor through the switches 2*b*. The amplifier is connected to the loud speakers 2*c*, and the analog audio signal is converted to the tones through the loud speakers 2*c*.

While a player is fingering a piece of music on the keyboard 10, the microprocessor runs on a main routine program, and the main routine program periodically selectively branches to sub-routine programs. The microprocessor is assumed to notice the player depress a white/black key 10*a*/10*b*. The associated key switch is closed with the depressed key 10*a*/10*b*, and the microprocessor determines a key code, which represents the pitch of the tone to be produced, assigned to the depressed key 10*a*/10*b*, and requests the tone generator sequentially to read out the pieces of waveform data from the waveform memory. The pieces of waveform data, i.e., a digital audio signal is converted to the analog audio signal through the digital-to-analog converter, and the analog audio signal is supplied through the amplifier to the loud speakers 2*c*. Thus, the tone generating system 2 is responsive to the fingering on the keyboard 10 so as to produce the tones.

As will be understood from the foregoing description, the sloped top surface permits the musician easily to manipulate the keyboard or write the notes into the staff without sharply bending the wrists. A player may put a music score on the sloped top surface 6*a* during a practice. The sloped top surface 6*a* makes the music score inclined, and the player feels the music score easy to read. Thus, the sloped top surface can serve as a music rack.

Second Embodiment

Figure 3:
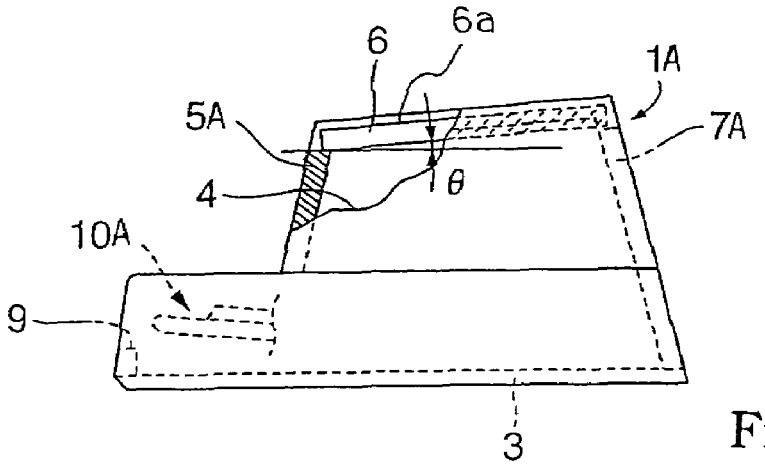
FIG. 3 is a partially cut-away side view showing the structure of another electronic keyboard musical instrument according to the present invention.

Turning to FIG. 3 of the drawings, another electronic keyboard musical instrument embodying the present invention largely comprises a cabinet 1A, a tone generating system (not shown) and a keyboard 10A. The tone generating system (not shown) and keyboard 10A are same as those 2 and 10 of the electronic keyboard musical instrument implementing the first embodiment. For this reason, description is focused on the cabinet 1A.

The cabinet 1A is analogous to the cabinet 1 except a front board 5A and a rear board 7A. The top surface 6*a* is also inclined at è. The other component boards 3, 4, 6, 8 and 9 are same as those of the cabinet 1, and no further description is hereinafter incorporated for the sake of simplicity.

The front board 5A and rear board 7A laterally extend between the side boards 4, and are secured to the side boards 4. However, the front board 5A and rear board 7A are shorter than the front board 5 and rear board 7 by the thickness of the top board 6. For this reason, when the side boards 4, front board 5A, rear board 7A and top board 6 are assembled into the cabinet 1A, the top board 6 does not project over the top surfaces of the side boards 4.

The advantages of the first embodiment are achieved by the electronic keyboard musical instrument implementing the second embodiment.

Third Embodiment

Figure 4:
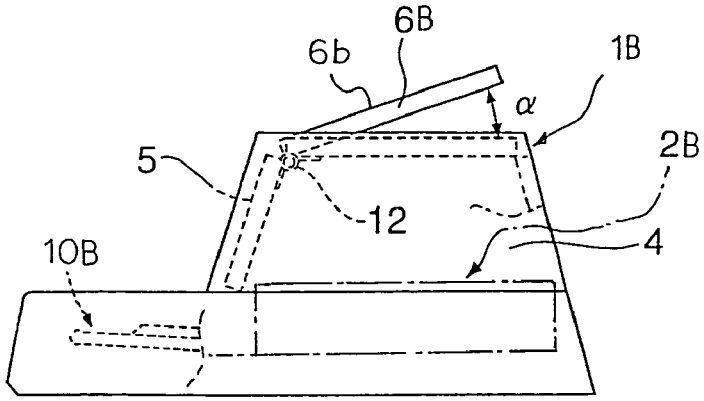
FIG. 4 is a side view showing the structure of yet another electronic keyboard musical instrument according to the present invention.

FIG. 4 shows yet another electronic keyboard musical instrument embodying the present invention. The electronic keyboard musical instrument implementing the third embodiment also largely comprises a cabinet 1B, a tone generating system 2B and a keyboard 10B. The tone generating system 2B and keyboard 10B are similar to those 2 and 10 of the first embodiment, and description is omitted for the sake of simplicity.

The cabinet 1B is analogous to the cabinet 1A. A difference from the cabinet 1A is a connection between the front board 5 and a top board 6B. For this reason, the connection between the front board 5 and the top board 6B is hereinafter described in detail. The top board 6B is per se as wide as the cabinet 1A, and defines the upper extent of the cabinet 1A. The top board 6B is connected to the front board 5 by means of a torque hinge 12. The torque hinge 12 is connected at one end thereof to the inner surface of the front board 5 and at the other end thereof to the lower surface of the top board 6B. The torque hinge 12 offers a substantial amount of resistance against the rotation of the top board 6B therearound. The substantial amount of resistance is large enough to keep the top board 6B and a keyboard on the top board 6B stable without changing angle à. However, the torque hinge 12 is not opposable against the moment exerted on the top board 6B by a user. For this reason, the user can change the angle à. The angle à is variable between zero and 80 degrees. When a user puts a sub-keyboard/computer keyboard/a notebook-sized personal computer or a music sheet on the top board 6B, the angle à may be adjusted to 5 degrees to 30 degrees. Thus, the cabinet 1B has a sloped top surface 6*b*. The torque hinge 12 keeps the top board 6B horizontal, any angle in the range or almost vertical.

When a musician wishes to manipulate a keyboard or write notes and rests on a music sheet together with the keyboard 10B, he or she puts the keyboard or music sheet on the top board 6B, and gives rise to rotation of the top board 6B about the torque hinge 12. The musician rotates the top board 6B and the keyboard/music sheet about the torque hinge 12, and optimizes the attitude of the top board 6B. When the musician finds the keyboard or music sheet optimum, he or she lets go his or her hold of the top board 6B. The torque hinge 12 keeps the top board 12B and keyboard/music sheet in the optimum attitude. The top board 6B and keyboard/music sheet enters the optimum attitude at 5-30 degrees.

If the musician wishes to practice a piece of music simply on the keyboard 10B, he or she may keep the top board 6B horizontal.

On the other hand, when the musician wishes to practice a piece of music on a music score, he or she rotates the top board 6B to the maximum angle, and stands the music score against the to board 6B. Thus, the torque hinge 12 makes the top board 6B serve as a music rack as well as a writing desk or a keyboard rack.

The electronic keyboard musical instrument implementing the third embodiment achieves all the advantages of the first embodiment. Moreover, the players can optimize the angle á at individual values by virtue of the torque hinge 12.

Fourth Embodiment

Figure 5:
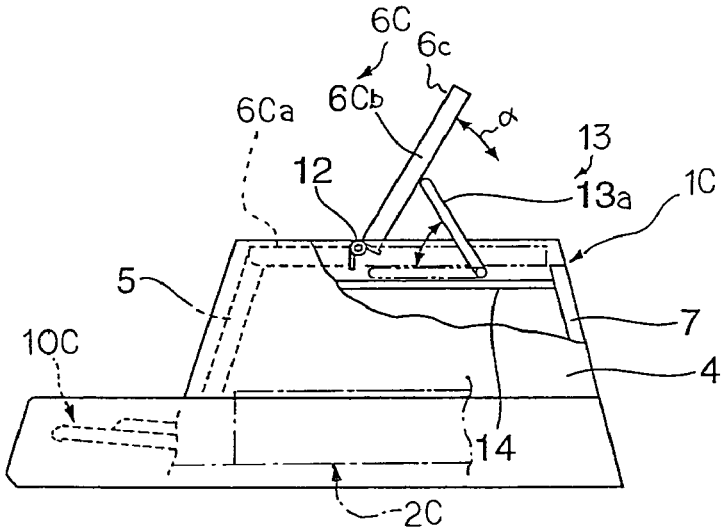
FIG. 5 is a partially cut-away side view showing the structure of still another electronic keyboard musical instrument according to the present invention.

FIG. 5 shows still another electronic keyboard musical instrument embodying the present invention. The electronic keyboard musical instrument implementing the fourth embodiment also largely comprises a cabinet 1C, a tone generating system 2C and a keyboard 10C. The tone generating system 2C and keyboard 10C are similar to those 2 and 10 of the first embodiment, and description is omitted for the sake of simplicity.

The cabinet 1C is analogous to the cabinet 1A. Differences from the cabinet 1A are a top board 6C, a connection between the front board 5 and a top board 6C and a prop 13 mechanism. For this reason, description is focused on those differences.

The top board 6C is as wide as the cabinet 1C, and defines the upper extent of the cabinet 1C. The top board 6C is split into a front top board 6Ca and a rear top board 6Cb. The front top board 6Ca is kept horizontal, and is secured to the front board 5 and side board 4. Thus, the front top board 6Ca is stable. The rear top board 6Cb is connected to the front top board 6Ca by means of the torque hinge 12. The torque hinge 12 is connected at one end thereof to the rear end surface of the front top board 6Ca and at the other end thereof to the front end surface of the rear top board 6Cb. The torque hinge 12 is same as that used in the third embodiment, and no further description is hereinafter incorporated for avoiding repetition.

The rear top board 6Cb is rotatable from the horizontal position to the maximum angle position, and keeps the rear top board 6Cb at an arbitrary angular position. Nevertheless, the prop mechanism 13 is desirable for enhancing the stability of the rear top board 8Cb. The prop mechanism 13 includes a movable frame 13*a* and a stationary frame 14. The stationary prop 14 is provided inside the cabinet 1C, and is secured to the side boards 5 and rear board 7. The movable frame 13*a* is hinged to the stationary frame 14. A user raises the movable frame from the stationary frame 14, and stands the rear top board 6Cb against the movable frame 13*a*. Even if the friction is reduced in the torque hinge 12 due to the aged deterioration, the prop mechanism 13 prevents the rear top board 6Cb from falling down together with a keyboard/music sheet.

When a user wishes to put a sub-keyboard/computer keyboard/a notebook-sized personal computer or a music sheet on the rear top board 6Cb, the angle à may be adjusted to 5 degrees to 30 degrees. Thus, the cabinet 1C has a sloped top surface 6*c*.

The electronic keyboard musical instrument implementing the fourth embodiment achieves all the advantages of the first embodiment. Moreover, the players can optimize the angle àat individual values by virtue of the torque hinge 12.

Fifth Embodiment

Figure 6:
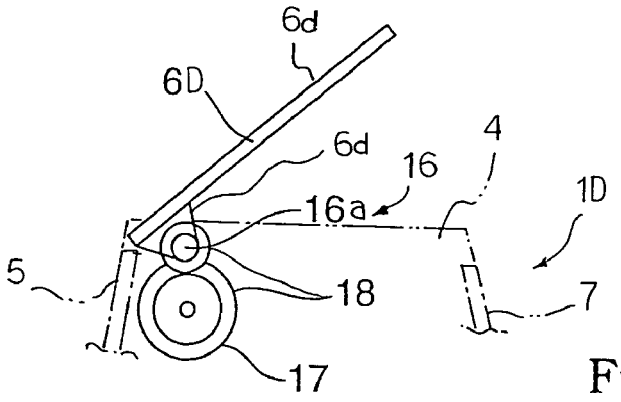
FIG. 6 is a side view showing a driving mechanism incorporated in a cabinet of yet another electronic keyboard musical instrument according to the present invention.

Turning to FIG. 6 of the drawings, yet another electronic keyboard musical instrument embodying the present invention largely comprises a cabinet 1D, a tone generating system (not shown) and a keyboard (not shown). The tone generating system and keyboard are same as those of the first embodiment. For this reason, description on the tone generating system and keyboard is omitted, and only the cabinet 1D is hereinafter described in detail.

The cabinet 1D is analogous to the cabinet 1A except a driving mechanism 16 for the top board 6D. The top board 6D is as wide as the cabinet 1D, and defines the upper extent of the cabinet 1D. The driving mechanism 16 includes a shaft 16*a*, an electric motor 17 and a pair of gears 18. The shaft 16*a* is rotatably supported by the side boards 4, and laterally extends over the inner space of the cabinet 1D. A pair of lugs 6*d* projects from the front end portion of the top board 6D, and is secured to the shaft 16*a*. An electric motor 17 is supported by one of the side boards 4, and the output shaft is laterally projects in such a manner as to be in parallel to the shaft 16*a*. The gears 18 are fixed to the shaft 16*a* and the output shaft of the electric motor 17, respectively, and are meshed with one another. Though not shown in FIG. 6, one of the switches 2*b* is assigned to the electric motor, and the microprocessor gives an instruction through the interface to a driving circuit for the electric motor 17.

A user is assumed to raise the top board 6D from the horizontal position to an optimum position. The user instructs the microprocessor to energize the electric motor 17 through the switch 2*b*. The microprocessor requests the driving circuit to energize the electric motor 17. Then, the electric motor 17 drives the output shaft to rotate in the clockwise direction in FIG. 6, and the torque is transferred from the output shaft through the gears 18 to the output shaft 16*a*. Then, the shaft 16*a* is driven for rotation in the counter clockwise direction, and the top board 6D rises. When the top board 6D reaches the optimum board attitude, the user instructs the microprocessor to stop the rotation. Then, the microprocessor requests the driving circuit to remove most of the electric power from the electric motor 17, and the motor 17 does not rotate the output shaft and, accordingly, the top board 6D. The electric motor 17 continuously exerts the small torque on the gears 18 so as to keep the top board 6D in the optimum board attitude.

When a user wishes to put a sub-keyboard/computer keyboard/a notebook-sized personal computer or a music sheet on the rear top board 6D, the angle may be adjusted to 5 degrees to 30 degrees. Thus, the cabinet 1D has a sloped top surface 6*d*.

The electronic keyboard musical instrument implementing the fifth embodiment achieves all the advantages of the first embodiment. Moreover, the driving mechanism 16 assists the user to change the top board 6D to the optimum board attitude so that the user easily optimizes the board attitude.

Sixth Embodiment

Figure 7:
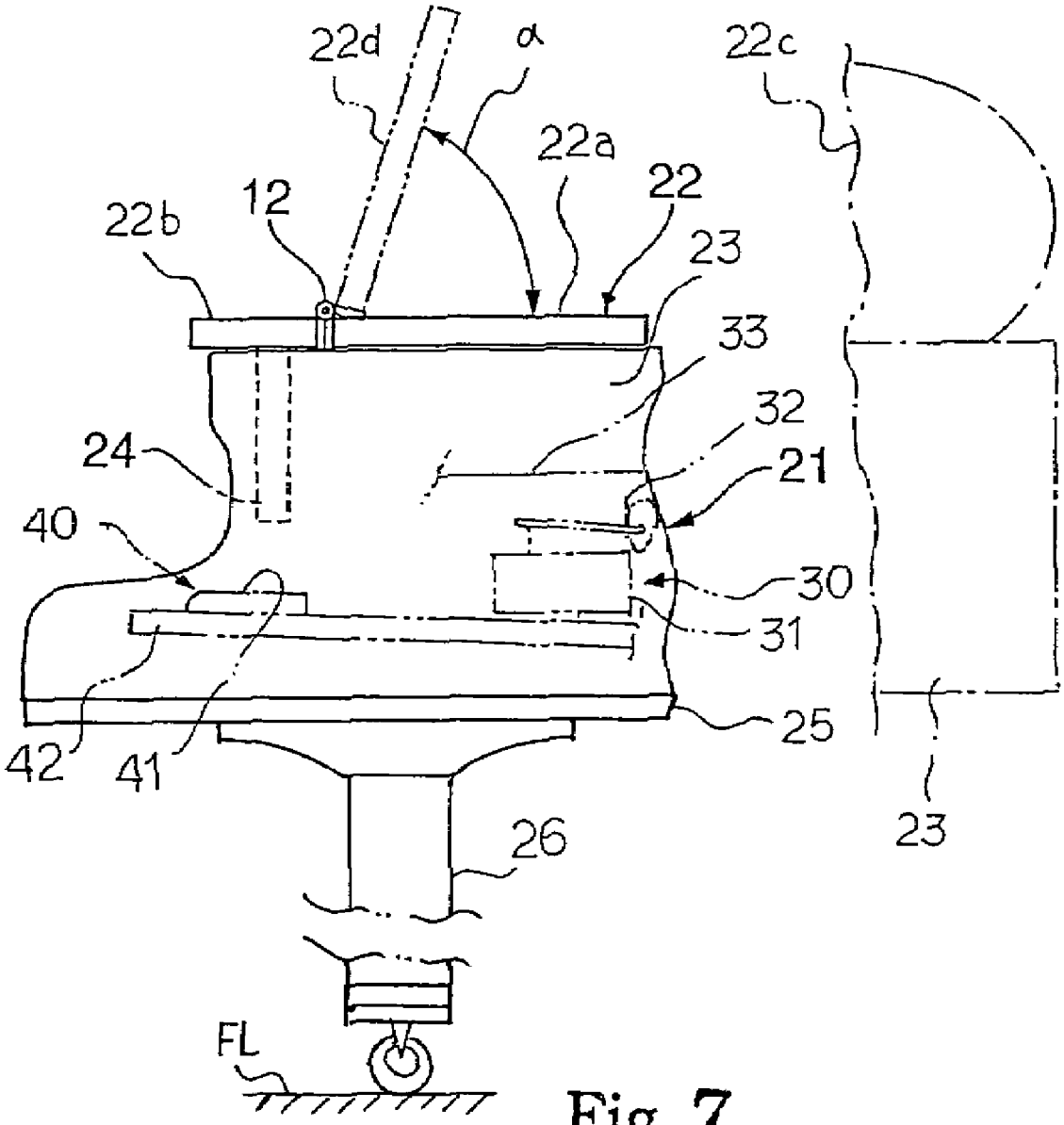
FIG. 7 is a side view showing the structure of a grand piano according to the present invention.

FIG. 7 shows a grand piano embodying the present invention. The grand piano implementing the sixth embodiment largely comprises a piano cabinet 21, a tone generating system 30 and a keyboard 40. The cabinet 21 defines an inner space, and the tone generating system 30 is housed in the cabinet 21. The keyboard 40 is partially housed in the cabinet 21, and is partially exposed to a player who is sitting on a stool. The player fingers a piece of music on the keyboard 40, which includes black keys 41 and white keys 42, and the keyboard 40 gives rise to action of the tone generating system 30. Then, the tone generating system 30 produces tones. Thus, the tone generating system is responsive to the fingering on the keyboard 40 so as to produce the tones.

In this instance, the tone generating system 30 includes action units 31, hammers 32 and strings 33. The black and white keys 41/42 are respectively linked with the action units 31. The depressed keys 41/42 give rise to actions of the associated action units 31, and the hammers 32 are independently driven for rotation through the associated action units 31. The strings 33 are stretched over the hammers 32, and are struck with the hammers 32 at the end of the rotation. The action units 31 and hammers 32 are similar to those of a standard grand piano, and no further description is hereinafter incorporated for the sake of simplicity.

The piano cabinet 21 includes a front top board 22, a side board 23, an upper beam 24, a key bed 25 and legs 26. The side board 23 is formed in a shape like a wing, and defines the side extent and rear extent of the piano cabinet 21. The keyboard 40 is mounted on the key bed 25, and the key bed 25 defines part of the bottom of the inner space. The upper beam 24 defines the front extent of the piano cabinet 21, and the front top board 22 defines the upper extend of the piano cabinet 21 together with a rear top board 22*c*. The rear top board 22*c* is hinged to the side board 23, and permits the tone generating system 30 to be open to the environment. The legs 26 stand on a floor FL, and keep the keyboard 40 and tone generating system 30 over the floor FL.

The front top board 22 is as wide as the piano cabinet 21, and is split into a movable board 22*a* and a stationary board 22*b*. The stationary board 22*b* is secured to the upper beam 24 and side board 23, and a torque hinge 12 is connected at one end thereof to the stationary board 22*b* and at the other end thereof to the movable board 22*a*. The torque hinge 12 is same as those used in the third and fourth embodiments (see FIGS. 4 and 5). For this reason, the torque hinge 12 keeps the movable board 22*a* at an arbitrary angle á. The angle á ranges from zero to 80 degrees. When a user puts a sub-keyboard/computer keyboard/a notebook-sized personal computer or a music sheet on the movable board 22*a*, the movable board 22*a* is optimized at 5 degrees to 30 degrees. Thus, the piano cabinet 21 has a sloped top surface 22*d*. On the other hand, when the user stands a music score on the movable board 22*a*, the angle áis further increased. Thus, the movable board 22*a* achieves all the advantages of the previous described embodiments.

As will be appreciated from the foregoing description, the cabinets 1, 1A, 1B, 1C, 1D and 22 have the sloped top surfaces 6*a*, 6*b*, 6*c*, 6*d* and 22*d*, and the sloped top surfaces 6*a*, 6*b*, 6*c*, 6*d* and 22*d* permit players to put an assistant device such as, for example, a sub-keyboard, a notebook-sized personal computer or a computer keyboard, a sheet of paper such as, for example, a music sheet or a writing pad or a printed matter on the sloped top surface without forcing the players to take unnatural attitude. Thus, the keyboard musical instrument according to the present invention is preferable to the prior art keyboard musical instruments.

Although particular embodiments of the present invention have been shown and described, it will be apparent to those skilled in the art that various changes and modifications may be made without departing from the spirit and scope of the present invention.

Figure 8:
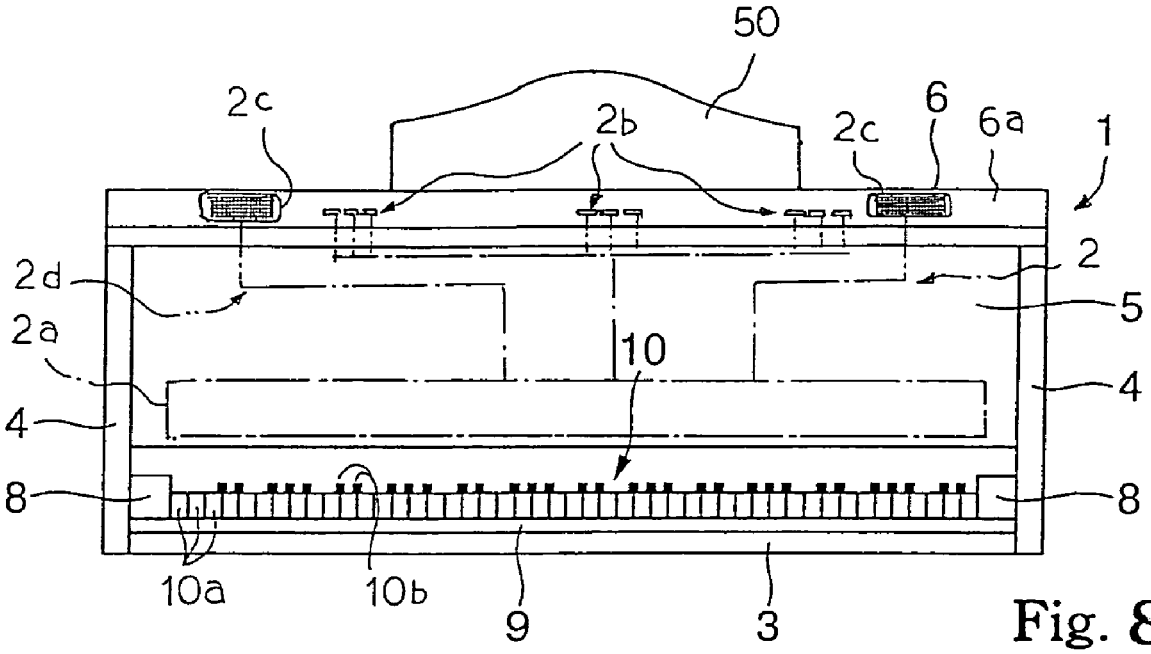
FIG. 8 is a front view showing the structure of a modification of the electronic keyboard musical instrument implementing the first embodiment.
Figure 9:
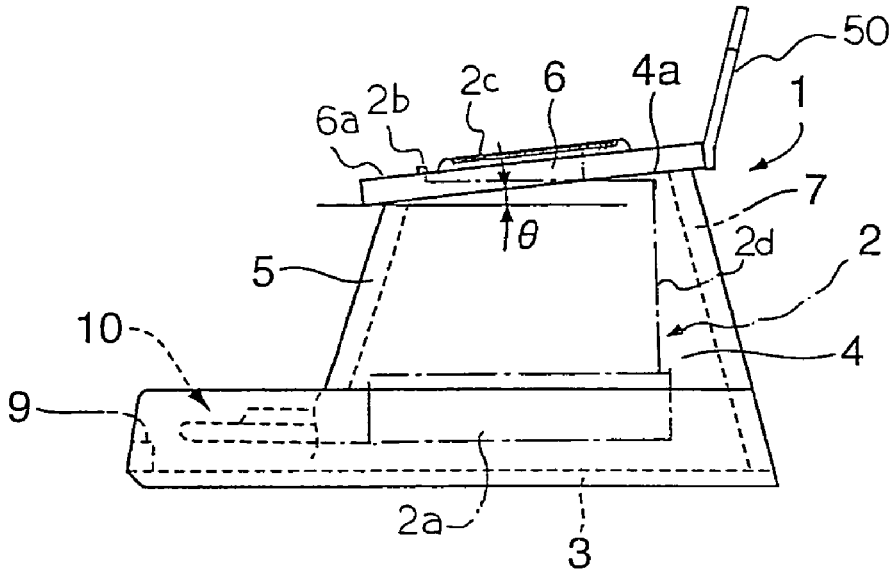
FIG. 9 is a side view showing the modification of the first embodiment.

The electronic keyboard musical instrument shown in FIGS. 1 and 2 may further includes a music rack 50, which upwardly rearward project from the rear end of the top board 6 as shown in FIGS. 8 and 9, so that a music score stands against the music rack 50. Music racks may be also provided for the other keyboard musical instruments implementing the second to sixth embodiments. The music racks are usually as wide as a printed matter spread thereon, and are narrower than the cabinets. Moreover, the music racks are added to the cabinets, the upper extents of which are defined by the top surfaces.

Legs downward project from the bottom board 3, and keep the cabinet 1 over the floor.

The torque hinge 12 may be replaced with a one-way clutch, which offers a large mount of resistance against the rotation in the clockwise direction and a negligible amount of resistance in the counter clockwise direction in FIGS. 4 and 5.

The torque hinge 12 may be replaced with a standard hinge in the embodiment shown in FIG. 7. In this instance, the prop mechanism 13 may be provided for the movable board 22*a*.

The electronic keyboard musical instrument and grand piano do not set any limit to the technical scope of the present invention. A piano cabinet for a compact upright piano may have a sloped top surface. Furthermore, the present invention is applicable to another sort of keyboard musical instrument such as, for example, a mute piano and an automatic player piano. The mute piano is a compromise between an acoustic piano and an electronic keyboard, and a hammer stopper is provided between the array of hammers and the strings. While a player is performing a piece of music through the acoustic tones, the hammer stopper is kept out of the trajectories of the hammers, and the strings are selectively struck with the hammers for producing the acoustic tones. On the other hand, when the player wishes to practice a piece of music without the acoustic tones, he or she moves the hammer stopper into the trajectories of the hammers. Although the hammers escape from the action units, the hammers rebound on the hammer stopper before striking the strings, and the acoustic tones are not produced. However, the electronic tone generating system monitors the key actions and produces electronic tones equivalent to the acoustic tones. If the player hears the electronic tones through a headphone, the player can practice the fingering without disturbing the neighborhood. The automatic player piano is fabricated on the basis of an acoustic piano, and is equipped with key actuators. The key actuators are selectively energized so as to push the black and white keys without any fingering of a human player. Thus, the automatic player piano reproduces a performance on the basis of music data codes.

The sloped top surfaces 6*a*, 6*b*, 6*c*, 6*d* and 22*d*, which are as wide as the cabinets 1, 1A, 1B, 1C, 1D and 21, do not set any limit to the technical scope of the present invention. A sloped top surface may define a part of the upper extend of the cabinet according to the present invention in so far as the assistant device or a sheet of paper is stable on the sloped area without any weight or clipper. A sloped top area may be created in a central area of a top surface of the top board or offset from a horizontal central area.

The angle è, which ranges from 5 degrees to 30 degrees, does not set any limit to the technical scope of the present invention. For example, in case where the friction between the assistant device/a sheet of paper and the sloped area is increased, the angle èmay be larger than 30 degrees. A rubber plate may be used for increasing the friction. Nevertheless, the angle range, 5 degrees to 30 degrees is suitable for the top board made of well-known material such as, for example, wood, metal, alloy and synthetic resin.

The sub-keyboard, computer keyboard, a notebook-sized personal computer are examples of the assistant device, and, accordingly, do not set any limit to the technical scope of the present invention. A portable rhythm machine, an electronic metronome, a ten key unit, an electronic tutor and a small-sized electronic musical instrument disclosed in Japanese Patent Application No. 2002-58494 are other example of the assistant device. In other words, the area of the sloped top surface may range from tens square-centimeters through thousands square-centimeters.

Claim languages are correlated with the component parts of the keyboard musical instruments implementing the first to sixth embodiments as follows. The sloped top surfaces 6*a*, 6*b* and 6*d* per se serve as "top surface", and the sloped top surfaces 6*c*/22*d* and the top surface of the front boards 6Ca/22*b* as a whole constitute the "top surface". The sloped top surfaces 6*a*, 6*b*, 6*c*, 6*d* and 22*d* are corresponding to "certain area".The sub-keyboard, computer keyboard, notebook-sized personal computer, music sheet and text book serve as "assistant materials". Of course, the portable rhythm machine, electronic metronome, ten key unit, electronic tutor, small-sized electronic musical instrument and writing pads are other assistant materials. The gears 18 as a whole constitute a "transmitting mechanism".

What is claimed is:

1. A keyboard musical instrument having a fore-and-aft direction and a lateral direction, comprising:

a cabinet including a top surface defining an upper extent of said cabinet and having a certain area sloping down toward a player who is fingering a music passage and keeping assistant materials stable thereon, said top surface having the certain area sloping down toward a player from one end of the top surface to another end of the top surface in the fore-and-aft direction;

a keyboard supported by said cabinet and manipulated by said player for said performance; and a tone generating system housed in said cabinet, and connected to said keyboard for producing tones, said tone generating system comprising action units respectively linked with keys of said keyboard, and hammers respectively driven for rotation by said action units.

2. The keyboard musical instrument as set forth in claim 1, in which said top surface slopes down toward said player so that said certain area is as wide as said top surface.

3. The keyboard musical instrument as set forth in claim 2, in which said cabinet has a top board providing said top surface sloping down toward said player to said assistant materials.

4. The keyboard musical instrument as set forth in claim 1, in which said top surface has said certain area and another area located in front of said certain area and extending in parallel to a floor where said keyboard musical instrument stands.

5. The keyboard musical instrument as set forth in claim 4, in which said cabinet has a top board containing said top surface having said certain area and said another area.

6. The keyboard musical instrument as set forth in claim 5, in which said top board is split into a front board having said another area and a rear board having said certain area.

7. The keyboard musical instrument as set forth in claim 1, in which an extension of said certain area crosses a floor where said keyboard musical instrument stands at a certain angle, and said certain angle ranges from 5 degrees to 30 degrees.

8. The keyboard musical instrument as set forth in claim 1, in which an extension of said certain area crosses a floor where said keyboard musical instrument stands at a certain angle, and said certain angle is variable.

9. The keyboard musical instrument as set forth in claim 8, in which said cabinet includes a front board stationary and substantially in parallel to said floor and a rear board movably connected to a rear end portion of said front board and offering said certain area to said assistant materials.

10. The keyboard musical instrument as set forth in claim 9, in which said front board is connected to said rear board by means of a hinge.

11. The keyboard musical instrument as set forth in claim 10, in which said hinge offers a resistance against rotation of said rear board so that said rear board keeps said assistant materials stable at any angular position.

12. The keyboard musical instrument as set forth in claim 9, in which a prop mechanism is provided for said rear board so as to keep said assistant materials stable on said rear board at any angular position.

13. The keyboard musical instrument as set forth in claim 1, in which said cabinet includes a top board containing said top surface having said certain area to said assistant materials, and said top board is rotatable so as to vary an angle between said certain area and a floor where said keyboard musical instrument stands.

14. The keyboard musical instrument as set forth in claim 13, in which a driving mechanism is provided for said top board, and said top board is rotated by means of said driving mechanism.

15. The keyboard musical instrument as set forth in claim 14, in which said driving mechanism includes an electric motor stationary with respect to said cabinet, and a transmitting mechanism provided between an output shaft of said electric motor and said rear board for transmitting a torque from said output shaft to said rear board.

16. The keyboard musical instrument as set forth in claim 1, in which said tone generating system electronically produces said tones.

17. The keyboard musical instrument as set forth in claim 1, in which said tone generating system produces acoustic tones.

18. The keyboard musical instrument as set forth in claim 17, in which said tone generating system includes strings respectively struck with said hammers at the end of said rotation.

19. The keyboard musical instrument as set forth in claim 18, in which said action units, said hammers and said strings are arranged in a similar manner to those of a standard grand piano, and said cabinet includes a side board defining a side extent and a rear extent of said cabinet and a front top board offering said certain area to said assistant materials and defining said upper extent together with a rear top board swingably connected to said side board.

20. The keyboard musical instrument as set forth in claim 19, in which said front top board is split into a front board stationary with respect to said side board and a rear board offering said certain area to said assistant materials and rotatable so as to change an angle between said certain area and a floor where said keyboard musical instrument stands.

* * * * *